United States Patent [19]

Ishima

[11] 4,158,848

[45] Jun. 19, 1979

[54] ELECTROSTATIC RECORDING MULTI-STYLUS ELECTRODE DEVICE

[75] Inventor: Kazumi Ishima, Kashiwa, Japan

[73] Assignee: Ricoh Co., Ltd., Japan

[21] Appl. No.: 910,011

[22] Filed: May 26, 1978

[30] Foreign Application Priority Data

May 31, 1977 [JP] Japan ..... 52-63539

[51] Int. Cl.[2] ..... G03G 15/04

[52] U.S. Cl. ..... 346/155; 346/139 C; 346/154

[58] Field of Search ..... 346/155, 154, 139 C; 358/300; 360/123

[56] References Cited

U.S. PATENT DOCUMENTS

| | | | |
|---|---|---|---|
| Re. 14,188 | 8/1916 | Hibbard | 346/162 |
| 2,303,472 | 12/1942 | Johnston | 346/162 |
| 3,750,792 | 8/1973 | Liles | 346/139 C |
| 3,783,237 | 1/1974 | McArthur | 346/163 |
| 4,028,711 | 6/1977 | Jost | 346/153 |
| 4,030,107 | 6/1977 | Tagawa | 346/155 |

*Primary Examiner*—Jay P. Lucas

*Attorney, Agent, or Firm*—McGlew and Tuttle

[57] ABSTRACT

The device comprises multiple stylus electrodes embedded in a row in an electrode support member, a plurality of common connecting conductive members which are arranged at substantially the same distance from the row of multiple stylus electrodes, parallel to each other with substantially the same distance therebetween, and which are disposed on a curved insulating base plate so that the lead wires for connecting the multiple stylus electrodes to the common connecting conductive members are substantially the same in length. The lead wires are arranged so as to be spaced from each other as far as possible for making uniform the distribution of the capacity of the capacitors formed between the respective lead wires and for reducing the absolute value of the capacity of the capacitors.

5 Claims, 8 Drawing Figures

ELECTROSTATIC RECORDING MULTI-STYLUS ELECTRODE DEVICE

BACKGROUND OF THE INVENTION

The present invention relates to an improved electrostatic recording multi-stylus electrode device for use with a facsimile apparatus or the like.

Conventionally, an electrostatic recording multi-stylus electrode device, as shown in FIGS. 1 to 4, is known for use with a facsimile apparatus or the like, in which a recording electrode comprising multiple stylus electrodes is arranged so as to face an auxiliary electrode (not shown) with a small gap therebetween, a recording medium comprising an insulating layer is placed between the recording electrode the auxiliary electrode, and voltage correlated to informatin information be recorded is applied across the recording electrode and the auxiliary electrode, and the recording medium is scanned by both electrodes so that a latent electrostatic image is formed on the recording medium, and, by developing the latent image, the information is recorded on the recording medium.

Referring to FIG. 1, multiple stylus electrodes P are embedded in a row in a rod-shaped electrode support member 1 made of a resin. The stylus electrodes P have to be embedded very closely in the row so that the stylus electrodes P can attain a high scanning density. However, in FIG. 1, the stylus electrodes P are illustrated with a large space therebetween for a better understanding of the arrangement of the respective multiple stylus electrodes.

The stylus electrodes are embedded in the form of an electrode row a—a and, as a whole, constitute a recording electrode and are respectively connected to lead wires $e_1, e_2, e_3, \ldots, e_n$, which are extended from "m" common connecting conductive members, for example, common connecting conductive members $q_1$, $q_2$, $q_3$ and $q_4$. These common connecting conductive members are arranged parallel to each other in an insulating base plate 2.

More specifically, the respective lead wires extended from the common connecting conductive members are connected to the stylus electrodes P spaced apart by $(m-1)$ stylus electrodes, for example, spaced apart by three stylus electrodes in FIGS. 1 to 4.

One end of each common connecting conductive member, such as $q_1$, $q_2$, $q_3$, $q_4$, is connected to a connector (not shown). When a latent electrostatic image is formed, an insulating recording medium is fed between the recording electrode and the auxiliary electrode (not shown) which is disposed in close proximity to the recording electrode, so that a potential correlated to information to be recorded is applied across the electrodes through each connector to scan the insulating recording medium.

Practically, the insulating base plate 2 and the electrode support member 1 are made integrally of a resin, such as epoxy resin, as shown in FIG. 2, so that one multi-stylus electrode device 3 is constructed as a whole. In FIG. 1, however, for a better understanding of the multi-stylus electrode device 3, each part is fragmentarily illustrated.

FIG. 3 shows the wiring of the multi-stylus electrode device 3.

In the conventional multi-stylus electrode of this type, a floating electrostatic capacity of capacitors formed between the lead wires $e_1, e_2, e_3, e_4, \ldots, e_n$, and between the common connecting conductive members $q_1$, $q_2$, $q_3$, $q_4$ becomes a problem when a potential is applied to the multi-stylus electrode device 3 for the formation of a latent electrostatic image. The term "floating electrostatic capacity" as used herein refers to the electrostatic capacity of the capacitors formed by the respective lead wires and the respective common connecting conductive members. Particularly, the floating electrostatic capacity of each capacitor formed between the lead wires $e_1, e_2, e_3, \ldots, e_n$, differs significantly since the length of each lead wire is different. This gives rise to an uneven image density. In this type of multi-stylus electrode device, the thus caused uneven image density is an important problem to be solved.

Conventionally, in order to solve this problem, a wiring method as shown in FIG. 4 has been proposed. In this method, the respective common connecting conductive members $q_1$, $q_2$, $q_3$, $q_4$ are disposed oppositely in the central portion of the electrode row a—a so that the relative length differences between the lead wires $e_1, e_2, e_3, e_4, \ldots, e_n$ which are extended from the common connecting conductive members and then connected to the stylus electrodes are made substantially equal in order to minimize the uneven distribution of the floating capacity in the recording electrode portion, for instance, in the respective connectors. However, this method cannot make the distribution of the floating electrostatic capacity completely uniform. Moreover, since the common connecting conductive members have to be disposed oppositely in the central portion of the insulating plate, the wiring is difficult and wrong wirings are apt to occur. In short, this method does not provide a perfect solution to the above-mentioned problem.

SUMMARY OF THE INVENTION

It is therefore a principal object of the invention to provide an electrostatic recording multi-stylus electrode device capable of attaining a uniform distribution of the floating capacity of the capacitors formed at the recording electrode portion of the multi-stylus electrode device.

Another object of the invention is to provide an electrostatic recording multi-stylus electrode device in which the absolute value of the floating capacity of the capacitors formed at the recording electrode portion is reduced, in addition to which the distribution of the floating capacity is made uniform.

According to one embodiment of the invention, multiple stylus electrodes are embedded in a row in a rod-shaped electrode support member and, at substantially equal spacings from the row of the stylus electrodes, a plurality of common connecting conductive members are arranged parallel to each other, with substantially the equal spacings therebetween, on a semi-cylindrical insulating base plate and the stylus electrodes are connected to the common connecting conductive members by the lead wires in such a manner that, when the same number of the stylus electrodes as that of the common connecting conductive members have been connected to the common connecting conductive members by the lead wires, the next same number of the stylus electrodes are connected to the same common connecting conductive members, and the same wiring procedure is repeated. Since the common connecting conductive members are arranged at substantially the same distance from the row of the stylus electrodes, the length of each lead wire connecting the common connecting conductive members to the stylus electrodes is the same so that the uneven distribution of the floating capacity of the capacitors formed between the respective leading wires is obviated.

The fact that the length of the lead wires is the same is a great advantage in fabricating the electrostatic recording multi-stylus electrode device.

In another embodiment of the invention, the stylus electrodes and the common connecting conductive members are connected by the lead wires in such a manner that the lead wires are apart from each other as far as possible so that the absolute value of the floating capacity of the capacitors formed between the respective lead wires is reduced significantly, in addition to the above-mentioned effect of obviating the uneven distribution of the floating capacity in the electrostatic recording multi-stylus electrode device.

BRIEF DESCRIPTION OF THE DRAWINGS

The foregoing and other features of the invention will be more apparent from a further reading of the specification and claims and from the drawings in which:

DETAILED DESCRIPTION OF PREFERRED EMBODIMENTS

Figure 1:
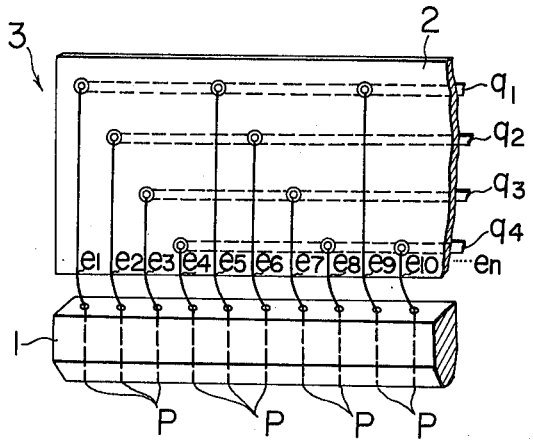
FIG. 1 PRIOR ART
FIG. 1 is a schematic perspective view of a main portion of a conventional electrostatic recording multi-stylus electrode.
Figure 2:
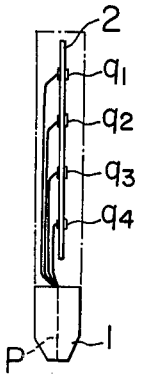
FIG. 2 PRIOR ART
FIG. 2 is a schematic sectional side view of the conventional electrostatic recording multi-stylus electrode of FIG. 1.
Figure 3:
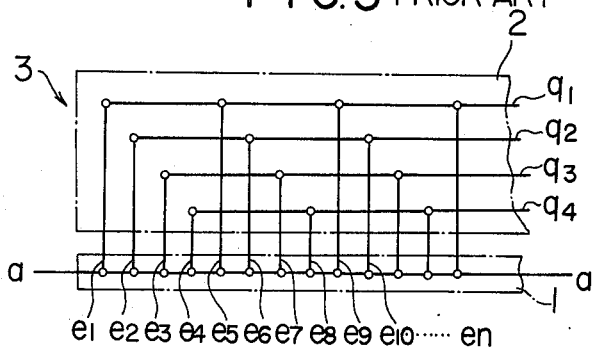
FIG. 3 PRIOR ART
FIG. 3 shows a wiring of the electrostatic recording multi-stylus electrode of FIG. 1.
Figure 4:
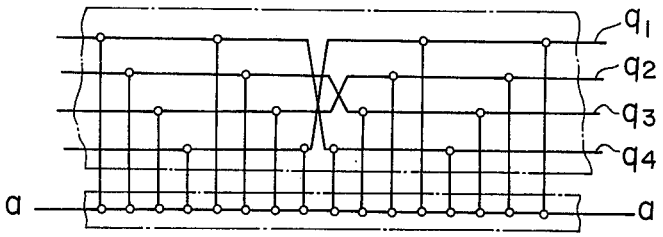
FIG. 4 PRIOR ART
FIG. 4 shows another wiring of the electrostatic recording multi-stylus electrode of FIG. 1.
Figure 5:
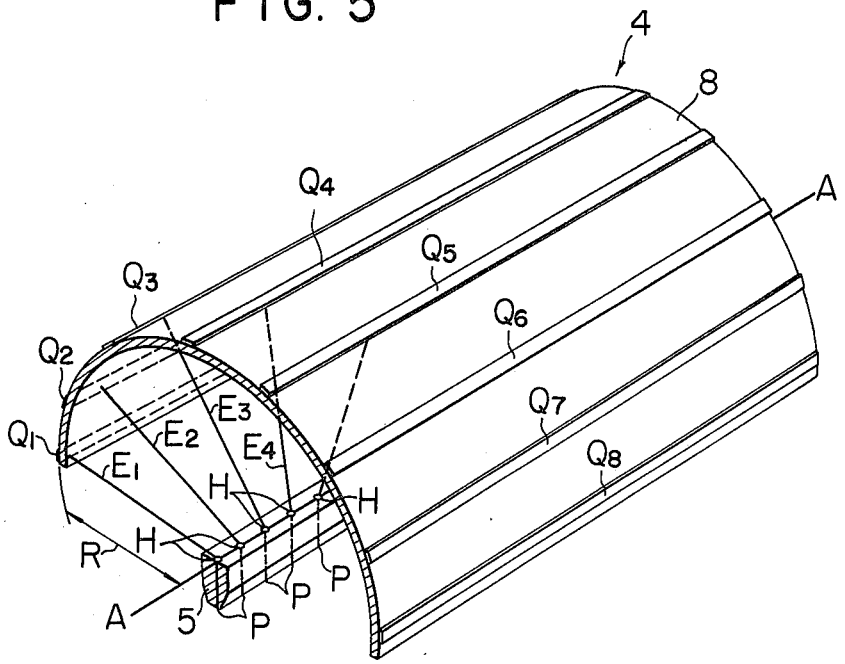
FIG. 5 is a schematic perspective view of a main portion of an embodiment of an electrostatic multi-stylus electrode of the invention.
Figure 6:
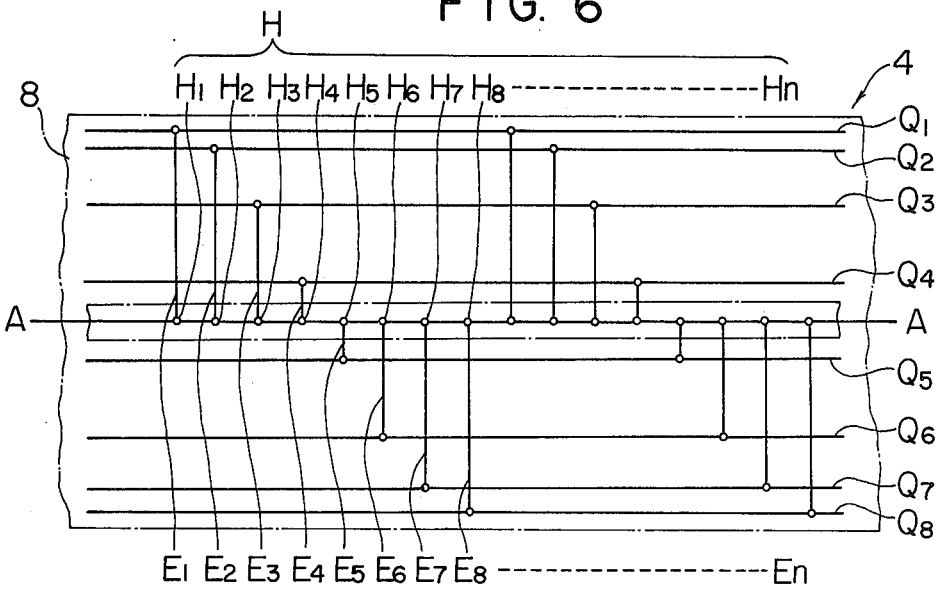
FIG. 6 shows the wiring of the electrostatic recording multi-stylus electrode of FIG. 5.

Referring to FIG. 5, there is shown perspectively a main portion of an embodiment of a multi-stylus electrode device 4 of the invention. FIG. 6 shows the wiring of the device 4 of FIG. 5. In FIG. 5, multiple stylus electrodes P are closely embedded in a row, with a predetermined space therebetween, in the longitudinal direction of a rod-shaped resin-made electrode support member 5.

The stylus electrode ends projected from the upper surface of the electrode support member 5 are respectively provided with lead wire connecting portions H having a terminal thereon. A line which passes through the respective lead wire connecting portions H is defined as an axis A—A.

In this embodiment of the invention, an insulating base plate 8 is made of a resin plate, whose section normal to a generating line of the insulating base plate 8 is in the shape of an arc, and which plate 8 is attached to the electrode support member 5 by appropriate means, with the axis of the arc-shaped insulating base plate 8 made to coincide with the axis A—A. On the outer peripheral surface of the insulating base plate 8, there are successively arranged eight common conductive members $Q_1, Q_2, Q_3, \ldots, Q_8$ from one side to the other side of the insulating base plate 8, equally spaced and parallel to the axis A—A. In other words, the common connecting conductive members $Q_1, Q_2, Q_3, \ldots, Q_8$ are arranged, equally spaced, on an arc having a radius R, whose center coincides with a row of the lead wire connecting portions H of the respective stylus electrodes P.

Since the common connecting conductive members are shaped like a narrow plate or wire, they can be printed on the insulating base plate 8 by a conventional printed-circuit manufacturing process.

The radius R and the number of the common connecting conductive members can be determined appropriately as desired in the invention.

Referring to FIG. 6, the wiring of the common connecting conductive members $Q_1, Q_2, Q_3, \ldots, Q_8$ and the respective lead wire connecting portions $H_1, H_2, H_3, \ldots, H_n$ of the stylus electrodes P by use of lead wires $E_1, E_2, E_3, \ldots, E_n$ is made as follows.

Assuming that eight common connecting conductive members $Q_1, Q_2, Q_3, \ldots, Q_8$ are disposed parallel to each other on the insulating base plate 8 as illustrated in FIG. 6, the first eight successive stylus electrodes are connected to the eight common connecting conductive members $Q_1, Q_2, Q_3, \ldots, Q_8$ one by one through the respective lead wire connecting portions $H_1, H_2, H_3, \ldots, H_8$ by the lead wires $E_1, E_2, E_3, \ldots, E_n$, and the second eight successive stylus electrodes are likewise connected to the same eight common connecting conductive members $Q_1, Q_2, Q_3, \ldots, Q_8$, and thereafter the same wiring is repeated.

Thus, in general, when there are "m" (an integer greater than 1) common connecting conductive members in all, the (pm $(pm+q)$th stylus electrode in the row of the stylus electrodes is connected to the (q)th common connecting conductive member of the common connecting conductive members by the lead wires $E_1, E_2, E_3, \ldots, E_n$, where $p=0, 1, 2, 3, \ldots, n$ (integer), $q=1, 2, 3, \ldots, m$ (integer), and "m" is the total number of the common connecting conductive members. to find which electrodes P are connected to any one particular conductive member Q,p is given each integer value up to n.

Figure 7:
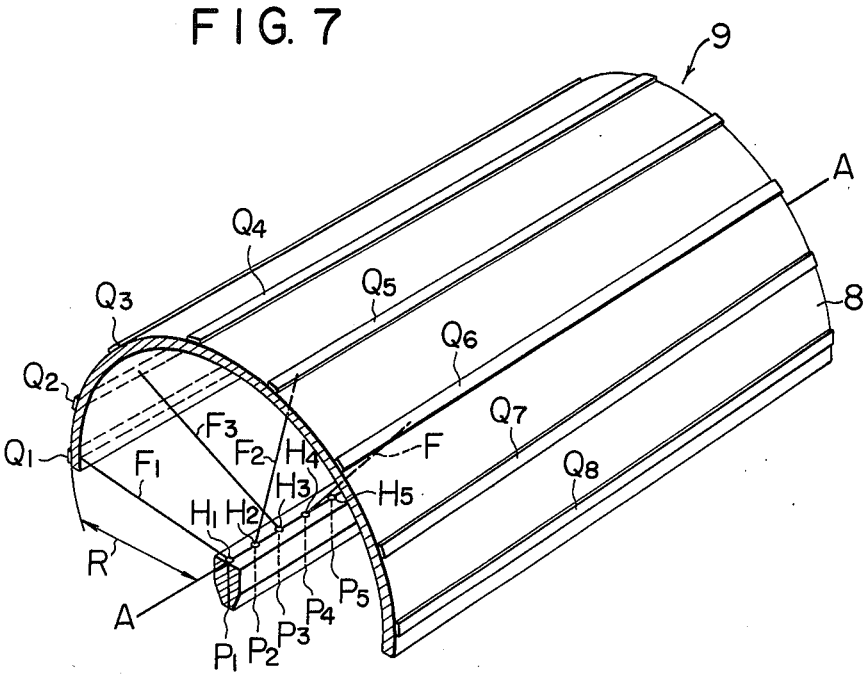
FIG. 7 is a schematic perspective view of a main portion of another embodiment of the electrostatic recording multi-stylus electrode of the invention.
Figure 8:
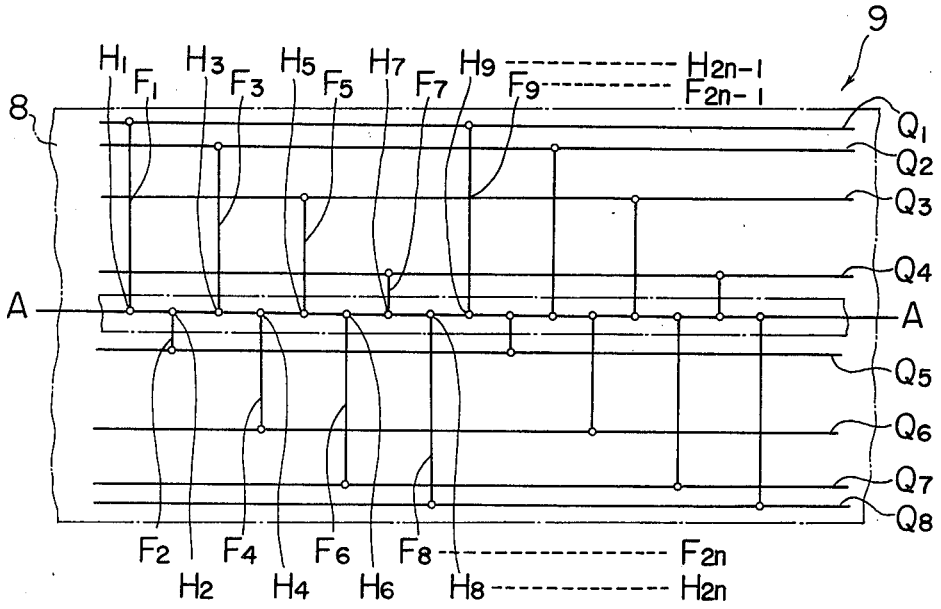
FIG. 8 shows the wiring the electrostatic recording multi-stylus electrode of FIG. 7.

FIG. 7 is a schematic perspective view of another embodiment of a multi-stylus electrode device 9 of the invention. FIG. 8 shows the wiring of the multi-stylus electrode device 9 of FIG. 7. In FIGS. 7 and 8, the elements common to those of the embodiment shown in FIGS. 5 and 6 are given identical reference numerals.

In FIGS. 7 and 8, the multi-stylus electrodes are successively referred to as $P_1, P_2, P_3, \ldots, P_n$, and the lead wire connecting portions for the respective multi-stylus electrodes are referred to as $H_1, H_2, \ldots, H_n$. Assuming that the lead wire connecting portion $H_1$ and the common connecting conductive member $Q_1$ are connected by a lead wire $F_1$, the leading wire connecting portion $H_2$ adjacent the lead wire connecting portion $H_1$ is connected to the common connecting conductive member $Q_5$ by the lead wire $F_2$. The common connecting conductive member $Q_5$ is the fifth common connecting wire counted from the common connecting conductive member $Q_1$. The lead wire connecting portion $H_3$ adjacent the lead wire connecting portion $H_2$ is connected to the common connecting conductive member $Q_2$ adjacent the common connecting conductive member $Q_1$ by the lead wire $F_3$, and the leading wire connecting portion $H_4$, adjacent the lead wire connecting portion $H_3$, is connected to the common connecting conductive member $Q_6$ adjacent the common connecting conductive member $Q_5$ by the lead wire $F_4$.

In case eight common connecting conductive members are provided, this wiring procedure can be summarized as in Table 1.

Table 1

(Refer to FIGS. 7 and 8.)

| Stylus Electrodes P (Lead Wire Connecting portion H) | Common Connecting Conductive Members |
|---|---|
| $P_1$ ($H_1$) | $Q_1$ |
| $P_2$ ($H_2$) | $Q_5$ |
| $P_3$ ($H_3$) | $Q_2$ |
| $P_4$ ($H_4$) | $Q_6$ |
| $P_5$ ($H_5$) | $Q_3$ |
| $P_6$ ($H_6$) | $Q_7$ |
| $P_7$ ($H_7$) | $Q_4$ |
| $P_8$ ($H_8$) | $Q_8$ |
| $P_9$ ($H_9$) | $Q_1$ |
| $P_{10}$($H_{10}$) | $Q_5$ |

This wiring procedure can be generalized as follows.

(1) When the total number of the common connecting conductive members is "n" (even), the $(2k-1)$th stylus electrode in "n" successive stylus electrodes of any segment of the row of the stylus electrodes is connected to (k)th common connecting conductive members in the "n" common connecting conductive members, the and (2k)th stylus electrode in the "n" successive stylus electrodes is connected to $(on/2+k)$th common connecting conductive member in the "n" common connecting conductive members, where $k=1, 2, 3, \ldots n/2$. This wiring procedure is repeated with every "n" stylus electrodes.

(2) When the total number of the common connecting conductive members is "m" (odd), the $(2l-1)$th stylus electrode in "m" successive stylus electrodes of any segment of the row of the stylus electrodes is connected to the (l)th common connecting conductive member in the "m" common connecting conductive members, and the (2l)th stylus electrode is connected to the $((m+1)/2+l)$th common connecting conductive member in the "m" common connecting conductive members, where $l=1, 2, 3, \ldots, (m-1)/2, (m+1)/2$. This wiring procedure is repeated with every segment of "m" successive stylus electrodes.

While specific embodiments of the invention have been shown and described in detail to illustrate the application of the principles of the invention, the invention may be embodied otherwise without departing from such principles.

What is claimed is:

1. In an electrostatic recording multi-stylus electrode device for use with a facsimile apparatus or the like, the improvement comprising:

multiple stylus electrodes embedded in at least one row in an electrode support member, a plurality of common connecting conductive members arranged at substantially equal distances from the row of said stylus electrode, parallel to each other with substantially equal spacings therebetween, a curved insulating base plate supporting said connecting conductive members, and lead wires connecting said multiple stylus electrodes to said common connecting conductive members.

2. An electrostatic recording multi-stylus electrode device as claimed in claim 1, wherein said common connecting conductive members are constituted by printed circuits manufacturing processes.

3. An electrostatic recording multi-stylus electrode device as claimed in claim 1, wherein the section of said curved insulating base plate normal to a generating line of said curved insulating base plate is in the shape of an arc.

4. An electrostatic recording multi-stylus electrode device as claimed in claim 1, wherein the (pm+q)th stylus electrode in the row of said stylus electrodes is connected to the (q)th common connecting conductive member of said common connecting conductive members disposed on said curved insulating base plate by said lead wires, where $p=0, 1, 2, \ldots, n$ (integer), $q=1, 2, 3, \ldots m$, (integer) and m is the total number of said common connecting conductive members and where each value for p is used for every value of q.

5. An electrostatic recording multi-stylus electrode device as claimed in claim 1, wherein when the total number of said common connecting conductive members is n (even), the $(2k-1)$th stylus electrode in "n" successive stylus electrodes of any segment of the row of said stylus electrodes is connected to the (k) th common connecting conductive members in said "n" common connecting conductive members, and the (2k) th stylus electrode in said "n" successive stylus electrodes is connected to the $(n/2+k)$ th common connecting conductive member in said "n" common connecting conductive members, where $K=1, 2, 3, \ldots n/2$, and this wiring procedure is repeated with every segment of "n" successive stylus electrodes; and when the total number of said common connecting conductive members is m (odd), the $(2l-1)$ th stylus electrode in "m" successive stylus electrodes of any segment of the row of said stylus electrodes is connected to the (l) th common connecting conductive member in said "m" common connecting conductive members, and the (2l) th stylus electrode is connected to the $((m+1)/2+l)$th common connecting conductive member in said "m" common connecting conductive members, where $l=1, 2, 3, \ldots (m-1)/2, (m+1)/2$, and this wiring procedure is repeated with every segment of "m" successive stylus electrode whereby a maximum spacing is provided between lead wires of adjacent electrodes in said row.

* * * * *